United States Patent [19]

Nawa

[11] 4,240,235

[45] Dec. 23, 1980

[54] GLAZED CLOSURE ASSEMBLY

[75] Inventor: Kooichiro Nawa, Kurobe, Japan

[73] Assignee: Yoshida Kogyo K.K., Tokyo, Japan

[21] Appl. No.: 41,391

[22] Filed: May 22, 1979

[30] Foreign Application Priority Data

May 24, 1978 [JP] Japan ..... 53-69021[U]

[51] Int. Cl.[3] ..... E04B 1/62

[52] U.S. Cl. ..... 52/397; 52/731; 49/501

[58] Field of Search ..... 49/501, 504; 52/400, 52/732, 397, 731, 823, 826

[56] References Cited

U.S. PATENT DOCUMENTS

| | | | |
|---|---|---|---|
| 3,114,944 | 12/1963 | Hargan, Jr. | 49/501 X |
| 3,344,575 | 10/1967 | Grossman | 49/504 X |
| 3,530,618 | 9/1970 | Grossman | 49/504 X |

*Primary Examiner*—Kenneth Downey

*Attorney, Agent, or Firm*—Hill, Van Santen, Steadman, Chiara & Simpson

[57] ABSTRACT

A glazed closure assembly such as a window sash or door comprises a pair of upper and lower rails of synthetic resin, a pair of metal attachments mounted in the rails, and a pair of stiles of synthetic resin, the attachments being connected endwise to the stiles by means of screws. A pane of glass is peripherally surrounded by a gasket that is mounted in the slots of the attachments and stiles.

4 Claims, 4 Drawing Figures

GLAZED CLOSURE ASSEMBLY

BACKGROUND OF THE INVENTION

1. Field of the Invention

The present invention relates to a glazed closure assembly such as a window sash or door, having rails and stiles made of synthetic resin.

2. Prior Art

There have been known window sashes or doors having frame members such as rails and stiles made of synthetic resin and a pane of glass supported between the frame members with a gasket interposed, the frame members being interconnected by means of screws extending threadedly into them. Such conventional arrangement, however, has proven disadvantageous in that the frame members do not provide enough dimensional stability and rigidity for secure retention of the pane of glass, and their strength on being assembled together is not sufficient because of the screws being tapped into a softer material. Further, the frame members tend to lose a required degree of durability due to creeping.

SUMMARY OF THE INVENTION

According to the present invention, a pair of attachments of metal are mounted respectively in a first pair of slots in a first pair of parallel spaced frame members of synthetic resin and are fastened endwise to a second pair of parallel spaced frame members of synthetic resin having a second pair of slots. The pair of attachments have a pair of third slots, respectively, facing toward each other. A pane of glass has its marginal edges supported by an elongate gasket extending therearound and disposed in the third pair of slots and the second pair of slots.

It is an object of the present invention to provide a glazed closure assembly including frame members fastened together with increased assembled strength.

Another object of the present invention is to provide a glazed closure assembly with a pane of glass retained stably between interconnected frame members.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
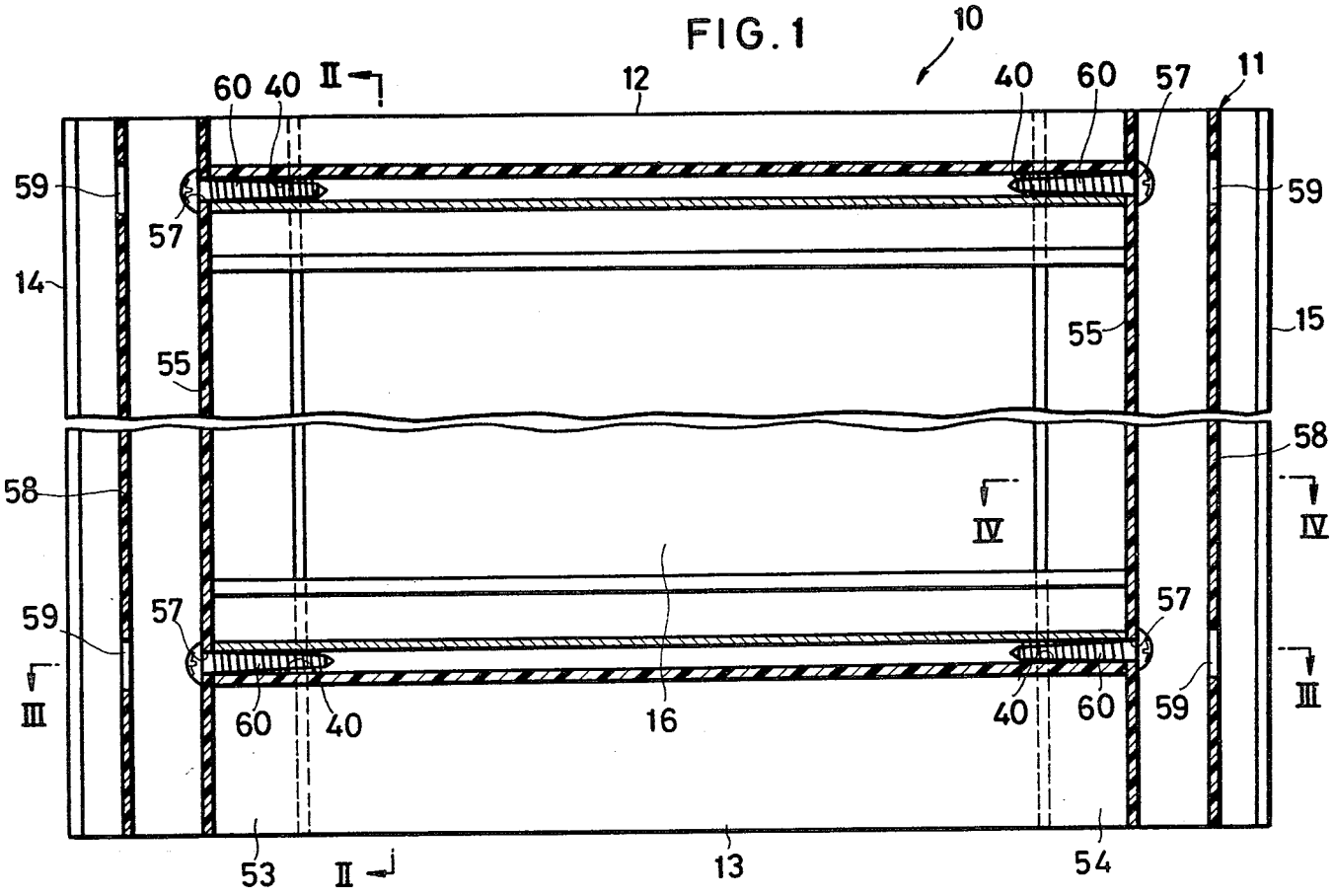
FIG. 1 is a vertical cross-sectional view, with a gasket omitted for clarity, of a glazed closure assembly constructed in accordance with the present invention.

The principles of the present invention are particularly useful when embodied in a glazed closure assembly illustrated in FIG. 1 and generally indicated by the reference numeral 10.

The glazed closure assembly 10 for use as a window sash or door, for example, comprises a frame 11 including a pair of upper and lower horizontal frame members or rails 12,13 vertically spaced from each other in parallel relationship and a pair of vertical frame members or stiles 14,15 horizontally spaced from each other in parallel relationship, the rails 12,13 being connected endwise to the stiles 14,15. The rails 12,13 and stiles 14,15 are made of synthetic resin. A pane of glass 16 is supported in the assembled rails 12,13 and stiles 14,15.

Figure 2:
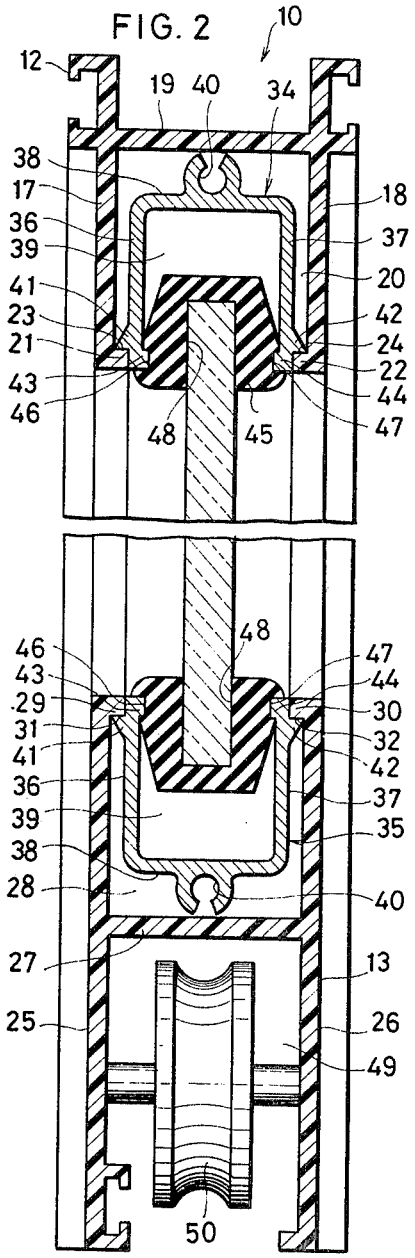
FIG. 2 is an enlarged cross-sectional view of the closure assembly taken along line II—II of FIG. 1.

As shown in FIG. 2, the upper rail 12 is of a substantially H-shaped cross section comprising a pair of spaced sidewalls 17,18 and a partition 19 extending between the sidewalls 17,18, there being an opening or slot 20 defined by the sidewalls 17,18 and partition 19. The sidewalls 17,18 have a pair of locking projections or ridges 21,22, respectively, located at inner edges of the sidewalls 17,18 and extending toward each other into the slot 20. The locking projections 21,22 have a pair of shoulders 23,24 facing toward the partition 19.

The lower rail 13 is likewise of a substantially H-shaped cross section comprising a pair of spaced sidewalls 25,26 and a partition 27 extending between the sidewalls 25,26, there being an opening or slot 28 defined by the sidewalls 25,26 and the partition 27 and facing toward the slot 20 in the upper rail 12. The sidewalls 25,26 have a pair of locking projections or ridges 29,30, respectively, located at inner edges of the sidewalls 25,26 and extending toward each other into the slot 28. The locking projections 29,30 have a pair of shoulders 31,32 facing toward the partition 27.

Figure 3:
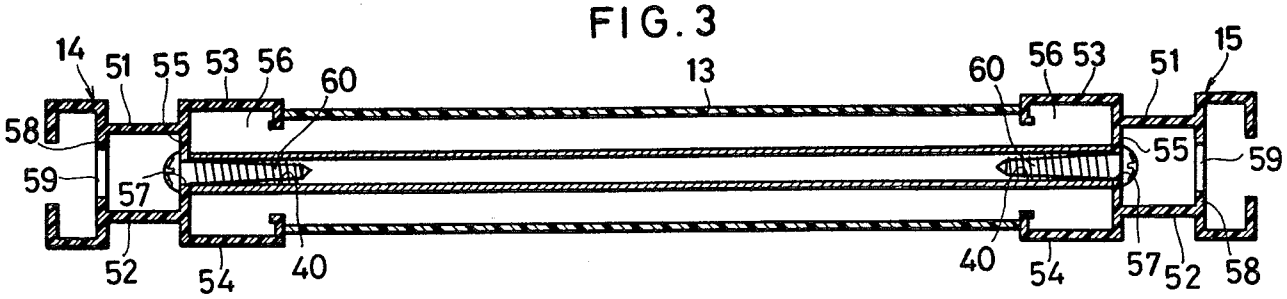
FIG. 3 is a cross-sectional view taken along line III—III of FIG. 1.

A pair of upper and lower elongate attachments 34,35 of a channel-shaped cross section are vertically spaced from each other and mounted respectively in the slots 20,28 in the upper and lower rails 12,13, the attachments 34,35 having a length substantially equal to that of the rails 12,13. Each of the attachments 34,35 is made of a metal such as extruded aluminium. Each attachment 34,35 has a pair of spaced sidewalls 36,37 and an end wall 38 extending between the sidewalls 36,37, the sidewalls 36,37 and the end wall 38 jointly providing an opening or slot 39. The slot 39 in one of the attachments 34 faces toward the slot 39 in the other attachment 35. Each of the attachments 34,35 includes a pair of sockets 40,40 mounted on the end wall 38 respectively at the ends of the elongate attachment, as best shown in FIG. 3.

The pair of sidewalls 36,37 of each attachment 34,35 has a pair of wedge-shaped projections or ridges 41,42, respectively, disposed on outer surfaces of the sidewalls 36,37 and interfitting or interlocking with the shoulders 23,24 or 31,32 on the rail sidewalls 17,18 or 25,26. The attachment sidewalls 36,37 further include a pair of locking projections 43,44 extending toward each other into the slot 39.

A rubber gasket or sealing member 45 of an elongate length has a pair of recesses 46,47 opening away from each other and a central slot 48 positioned between the recesses 46,47. The gasket 45 extends around or surrounds the pane of glass 16 with the marginal edges of the glass disposed in the central slot 48 of the gasket 45 so as to be supported thereby. The locking projections 43,44 on the attachment sidewalls 36,38 are received respectively in the recesses 46,47 in the gasket 45.

The lower rail 13 has a channel 49 opening downwardly and receiving rollers 50 rotatably supported on the lower rail 13 for rolling engagement with a rail (not shown) mounted on a sill.

Figure 4:
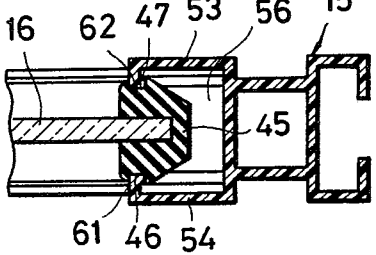
FIG. 4 is a cross-sectional view of the closure assembly taken along line IV—IV of FIG. 1.

Each stile 14,15 of FIG. 3 includes a pair of spaced central walls 51,52 and a pair of sidewalls 53,54 interconnected by a partition 55 extending therebetween, the central walls 51,52 being connected to the partition 55. The sidewalls 53,54 and the partition 55 jointly define an opening or slot 56 in which the gasket 45 is disposed, as shown in FIG. 4. The partition 55 has a number of screw apertures 57 which are aligned with a number of access apertures 59 in a partition 58 extending between the central walls 51,52.

Self-tapping screws 60 extend through the apertures 57 threadedly into the sockets 40.

As shown in FIG. 4, the sidewalls 53,54 of each stile 14,15 have a pair of locking projections or ridges 61,62 extending toward each other into the slot 56 and received respectively in the recesses 46,47 in the gasket 45.

The glazed closure assembly 10 is assembled as follows: The upper and lower attachments 34,35 are inserted into the slots 20,28 in the upper and lower rails 12,13, respectively, until the wedge-shaped locking projections 41,42 on the attachments 34,35 move past the locking projections 21,22 and 29,30 on the upper and lower rails 12,13 and snappingly engage the shoulders 23,24 and 31,32 of the locking projections 21,22 and 29,30, respectively. Then, the gasket 45 disposed around the periphery of the glass pane 16 is forced into the slots 39,39 in the attachments 34,35 until the locking projections 43,44 are placed in the recesses 46,47 in the gasket 45. The stiles 14,15 are fitted across the ends of the upper and lower rails 12,13 with the gasket 45 being pushed into the slots 56 in the stiles 14,15. After the locking projections 61,62 on the stiles 14,15 are received in the recesses 46,47 in the gasket 45, the screws 60 are put through the apertures 59,57 in the stiles 14,15 and threaded into the sockets 40 of the attachments 34,35.

With this arrangement, the glass pane 16 is stably supported by the metal attachments 34,35, and the entire glazed closure assembly 10 is of a rugged structure because the screws 60 threadedly engage the metal attachments 34,35 in attaching the stiles 14,15 to the upper and lower rails 12,13.

Instead of placing the attachments 34,35 in the rails 12,13, they may be mounted in the stiles 14,15.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A glazed closure assembly comprising:

(a) a first pair of parallel spaced frame members made of synthetic resin and having a first pair of slots, respectively, facing toward each other;

(b) a second pair of parallel spaced frame members, perpendicular to said first pair, made of synthetic resin and having a second pair of slots, respectively, facing toward each other;

(c) a pair of parallel spaced attachments made of metal and mounted respectively in said first pair of slots, said attachments having a third pair of slots, respectively, facing toward each other and a pair of fastener-receiving means, respectively, remote from said third pair of slots and opening at the ends of said attachments which confront said second frame members;

(d) gasket means disposed in said third pair of slots and said second pair of slots;

(e) a pane of glass having its marginal edges supported by said gasket extending therearound; and (f) fastener means extending through said second frame members threadedly into said fastener-receiving means, whereby said attachments are connected endwise to said second pair of parallel spaced frame members.

2. A glazed closure assembly according to claim 1, each of said pair of attachments comprising an elongated channel-shaped structure having a length substantially equal to that of one of said first pair of frame members, said channel-shaped structure including a pair of sidewalls, an end wall extending between said sidewalls, and each of said fastener-receiving means comprising a pair of sockets mounted on said end wall respectively at the ends of said elongated structure and disposed in one of said first pair of slots in said first frame members.

3. A glazed closure assembly according to claim 2, each of said pair of first frame members comprising a pair of sidewalls and a partition extending therebetween, including a pair of first locking projections extending from said sidewalls of said each first frame member toward each other into the first slot, each of said first locking projections having a shoulder facing toward said partition, and a pair of wedge-shaped locking projections extending from the sidewalls of said attachment, and each having a surface held against said shoulder and a slant surface held out of engagement with said sidewall of said first frame member.

4. A glazed closure assembly according to claim 2, including a pair of locking projections extending respectively from said sidewalls toward each other into said third slot, said gasket having in its opposite walls a pair of recesses opening away from each other, said locking projections being lockingly fitted respectively in said recesses.

* * * * *